US006729664B1

(12) United States Patent
Marsh et al.

(10) Patent No.: US 6,729,664 B1
(45) Date of Patent: May 4, 2004

(54) CUSHIONING DEVICE FOR FURNITURE

(75) Inventors: Thomas R. Marsh, High Point, NC (US); Robert C. Hightower, High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 10/268,034

(22) Filed: Oct. 9, 2002

(51) Int. Cl.[7] ..... E05C 19/18

(52) U.S. Cl. ..... 292/280; 292/145; 292/254; 292/297

(58) Field of Search ..... 292/282, 254, 292/145, 297; 312/236

(56) References Cited

U.S. PATENT DOCUMENTS

| | | | | | |
|---|---|---|---|---|---|
| 2,536,941 | A | * | 1/1951 | Jones | 292/288 |
| 3,069,217 | A | * | 12/1962 | Kors | 312/209 |
| 3,938,839 | A | * | 2/1976 | Collier | 292/258 |
| 3,997,205 | A | | 12/1976 | MacDonald | 292/288 |
| 4,067,605 | A | * | 1/1978 | Green et al. | 296/218 |
| 4,120,524 | A | * | 10/1978 | Buck, Jr. | 292/263 |
| 4,216,983 | A | * | 8/1980 | Hough et al. | 292/263 |
| 4,383,709 | A | * | 5/1983 | Ronan | 292/346 |
| 4,399,672 | A | * | 8/1983 | Moorhouse | 70/101 |
| 4,672,693 | A | * | 6/1987 | Schenstrom | 4/555 |
| 4,955,648 | A | * | 9/1990 | Miller | 292/258 |
| 5,125,699 | A | * | 6/1992 | Dinan | 292/288 |
| 5,203,597 | A | * | 4/1993 | Wheelock | 292/258 |
| 6,412,149 | B1 | * | 7/2002 | Overberg | 24/455 |
| 6,510,587 | B2 | * | 1/2003 | Urschel et al. | 16/83 |
| 6,533,374 | B2 | * | 3/2003 | Hightower | 312/236 |
| 2002/0089269 | A1 | | 7/2002 | Hightower | 312/236 |

FOREIGN PATENT DOCUMENTS

| | | |
|---|---|---|
| DE | 3514244 | * 10/1986 |

* cited by examiner

*Primary Examiner*—James R. Brittain
*Assistant Examiner*—Carlos Lugo
(74) *Attorney, Agent, or Firm*—Myers Bigel Sibley & Sajovec

(57) ABSTRACT

A device for protecting first and second confronting furniture components includes a base member having opposite first and second faces. The first face is adapted to contact the first furniture component, and the base member has a cushioning projection that extends outwardly from the second face of the base member and covers a void within the base member. The projection is adapted to contact the second furniture component as it confronts the first furniture component.

42 Claims, 7 Drawing Sheets

CUSHIONING DEVICE FOR FURNITURE

FIELD OF THE INVENTION

The present invention relates generally to furniture and, more particularly, to devices for protecting furniture from damage during normal use, shipping and handling.

BACKGROUND OF THE INVENTION

Various types of furniture such as cabinets, dressers, and the like, have movable components such as doors or drawers that open and close against a frame. The opening and closing of such furniture components may cause damage to the frame under normal usage. In addition, during shipping or handling, furniture parts may swing open with more force than is typical under normal usage and cause additional wear and tear on the furniture piece. This tendency may be particularly problematic for heavy doors, furniture with sharp edges, or furniture made from less durable materials prone to damage.

Devices have been developed for temporarily restraining furniture doors from lateral movement during shipping and handling. For example, U.S. Pat. No. 3,997,205 describes a cabinet door clip formed with a pair of U-shaped bends that are configured to limit lateral movement of a cabinet door. Co-assigned and co-pending U.S. Publication No. 2002-0089269 filed Jan. 10, 2001 describes a cabinet door clip configured for restraining furniture doors from both vertical and horizontal movement relative to a frame during shipping and handling. The disclosures of both U.S. Pat. No. 3,997,205 and U.S. Publication No. 2002-0089269 are hereby incorporated herein by reference in their entireties. However, even when a door, drawer, or other movable furniture component is restrained during shipping, damage can occur. For example, many furniture clips allow some motion, which may be significant enough to cause damage to furniture surfaces.

Damage from movable furniture components can also occur during normal usage. Various cushioning devices have been made to protect furniture at the interface between a frame and a movable part. Such devices can typically require a hard plastic portion to hold the device in place and a softer plastic portion to provide a cushion. Devices made from two types of plastic materials of differing rigidity may be expensive and cumbersome to make. Alternatively, adhesive may be used to affix a soft plastic or rubber cushion to the point of contact to protect furniture parts. However, adhesives can leave undesirable glue residue on the furniture piece and harm furniture finishes.

SUMMARY OF THE INVENTION

In view of the above discussion, cushioning devices for protecting movable furniture components and frames are provided. In certain embodiments, a device for protecting first and second confronting furniture components includes a base member having opposite first and second faces. The first face is adapted to contact the first furniture component, and the base member has a cushioning projection that extends outwardly from the second face of the base member and covers a void within the base member. The projection is adapted to contact the second furniture component as it confronts the first furniture component.

In some embodiments, a device for securing and protecting confronting movable and frame members of a furniture piece includes a base member having opposite first and second faces. The first face is adapted to contact the frame member, and the base member has a cushioning projection extending outwardly from the second face of the base member and covering a void within the base member. The projection is adapted to contact the movable member as it confronts the frame member of the furniture piece. A securing member extends outwardly from the base member second side and is configured to removably secure the movable member against the cushioning projection.

In other embodiments, a device for protecting opposing furniture components includes first and second base members extending away from a common vertex. The first and second base members each have first and second opposing faces. The first face is adapted to contact the first furniture component. The first and second base members each have a cushioning projection extending outwardly from the second faces of the first and second base members. Each projection is adapted to contact the second furniture component as it confronts the first furniture component.

In further embodiments, an article of furniture is provided that includes a frame, a movable member connected with the frame and movable from an open position to a closed position, and a device for protecting the movable member in a closed position relative to the frame. The device includes a base member having opposite first and second faces. The first face is adapted to contact the frame. The base member has a cushioning projection extending outwardly from the second face of the base member and covering a void within the base member. The projection is adapted to contact the movable member as it confronts the frame.

In still further embodiments a method for manufacturing a device for protecting first and second confronting furniture components includes providing a mold including a pair of mating mold halves that form a cavity. The cavity is configured to form a base member having opposite first and second faces. The first face is adapted to contact the first furniture component and the second face has a cushioning projection extending away from the second face. Molten polymeric material is injected into the cavity. A gas is injected into the cavity at a pressure sufficient to cause a void to form within the base member so that the cushioning projection covers the void. The polymeric material is cooled to a solid state such that it forms a cushioning device.

DETAILED DESCRIPTION OF THE INVENTION

Figure 1:
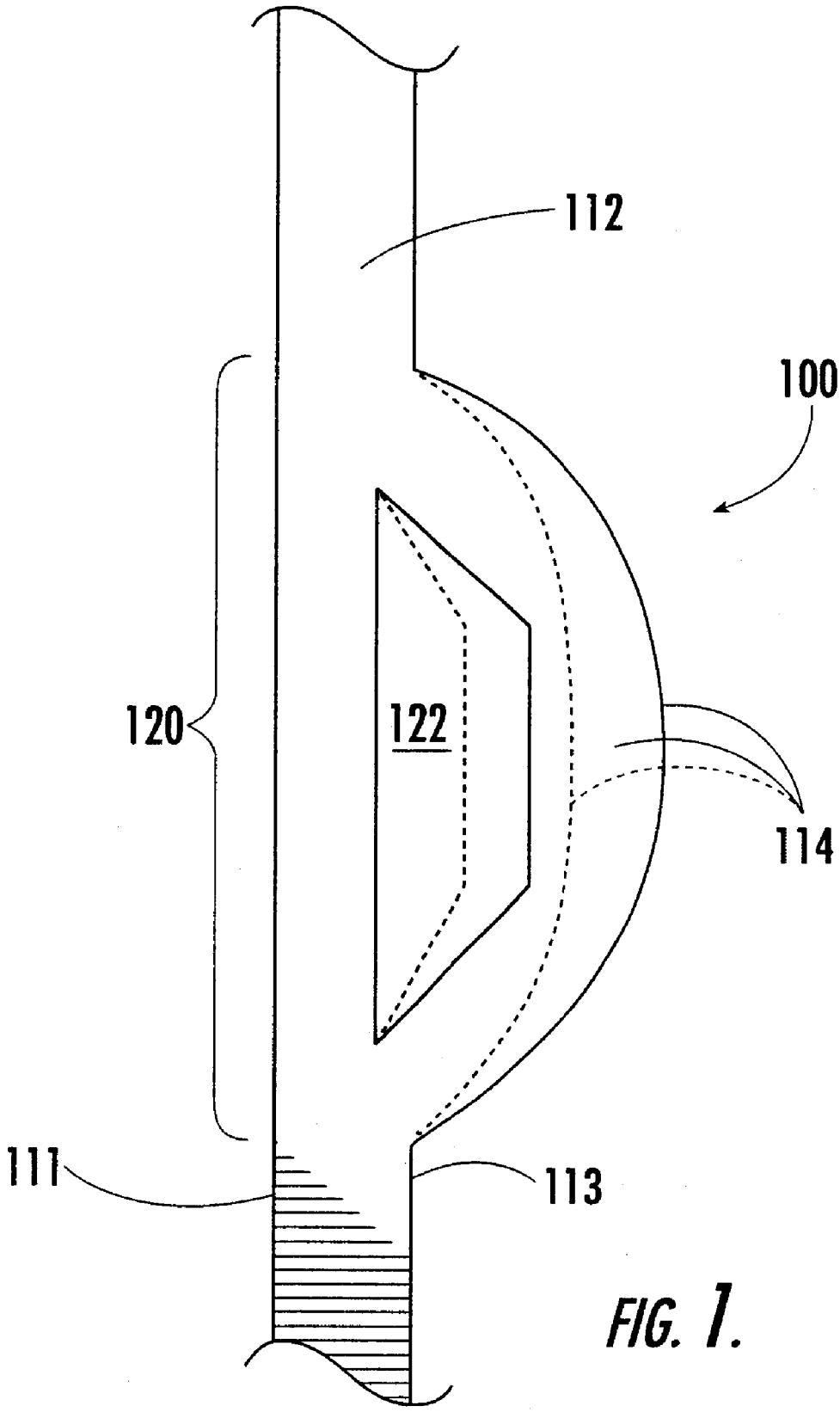
FIG. 1 is a side view of a cushioning device according to embodiments of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The present invention relates to cushioning devices that can be used to protect movable furniture parts during shipping and handling and/or during normal usage. Cushioning devices according to certain embodiments of the invention may be manufactured economically from a single piece of material using various inexpensive materials and known manufacturing techniques including injection molding and gas assist molding. Gas assist molding involves the injection of a gas into a cavity that has been partially filled with resin. The gas injection can be used to create a void in the molded component.

For ease of discussion, the embodiments described herein are shown with reference to a door and frame. However, cushioning devices according to embodiments of the invention may be used in connection with any movable furniture component, including cabinet drawers, doors, and corresponding frame components.

A cushion 100 according to embodiments of the present invention is illustrated in FIG. 1. The cushion 100 includes a base 112 with two opposing faces 111 and 113 and a convex cushioning projection 114 on one face 113. As illustrated by the phantom lines in FIG. 1, the projection 114 is compressible. The projection 114 covers a void 122 within the base 112. The base 112 includes a planar portion 120 opposite the cushioning projection 114 that has a thickness that is less than the thickness of the base 112.

The cushion 100 can be used to protect confronting furniture components. The face 111 can be configured to contact a furniture component such as a frame that confronts a movable component such as a door or drawer. The projection 114 may contact the movable furniture component as it confronts the opposing furniture component such that the furniture components are protected from damage.

The projection 114 can have varying degrees of compressibility. In certain embodiments of the present invention, a rigid projection is provided that is not compressible and can cushion furniture components by providing a curved surface.

In certain embodiments, and as noted above, the convex projection 114 and/or the planar portion 120 opposite the projection 114 can have a thickness that is less than the thickness of the base 112. Depending on the materials used and the dimensions desired, it may be possible to manufacture a cushion 100 inexpensively as a unitary member (i.e., from a single piece of material) such that the cushioning projection 114 is thinner and more resilient than the base 112. Such devices may be easier and less expensive to manufacture than multi-component prior art cushions made from a rigid material to hold the device in place and a softer material to cushion the furniture components. For example, in certain embodiments described herein, the base 112 may be modified to provide a hooking or clipping mechanism for attachment to a furniture component. Such mechanisms for attachment may require that the base 112 be relatively rigid. However, a more resilient, compressible projection 114 may be desirable to cushion and project furniture components.

Figure 2:
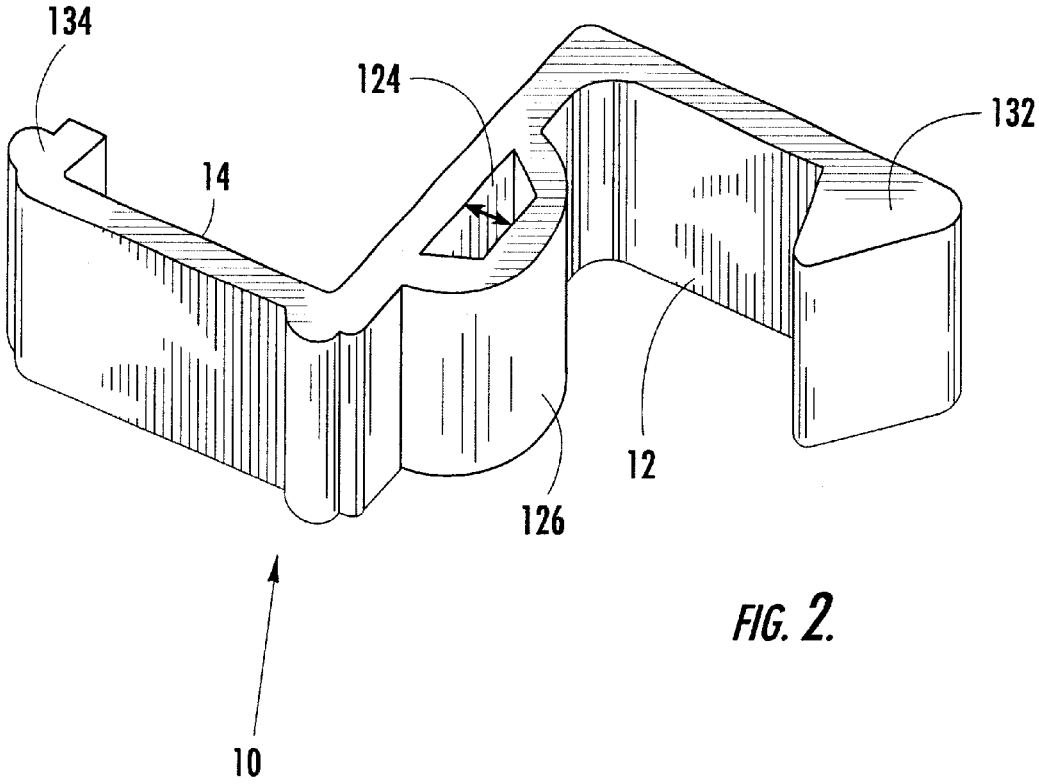
FIG. 2 is a perspective view of a restraining clip for restraining furniture doors from opening during shipping and handling having a cushion according to embodiments of the present invention.

FIG. 2 illustrates a restraining clip 10 for restraining furniture doors and/or drawers from lateral movement during shipping and handling. The clip 10 includes a compressible cushion 126 that covers a void 124. The cushion 126 is elongated, and the void 124 extends through the cushion 126 and forms an opening at both ends. However, various shaped cushions may be used having one or more openings. In some embodiments, a cushion is provided that completely covers the void such that there are no openings. Examples of cushion shapes include three-dimensional shapes such as hemispheres, hemi-ellipsoids, polyhedrons, semi-cylinders, half-cones, and the like.

Figure 3:
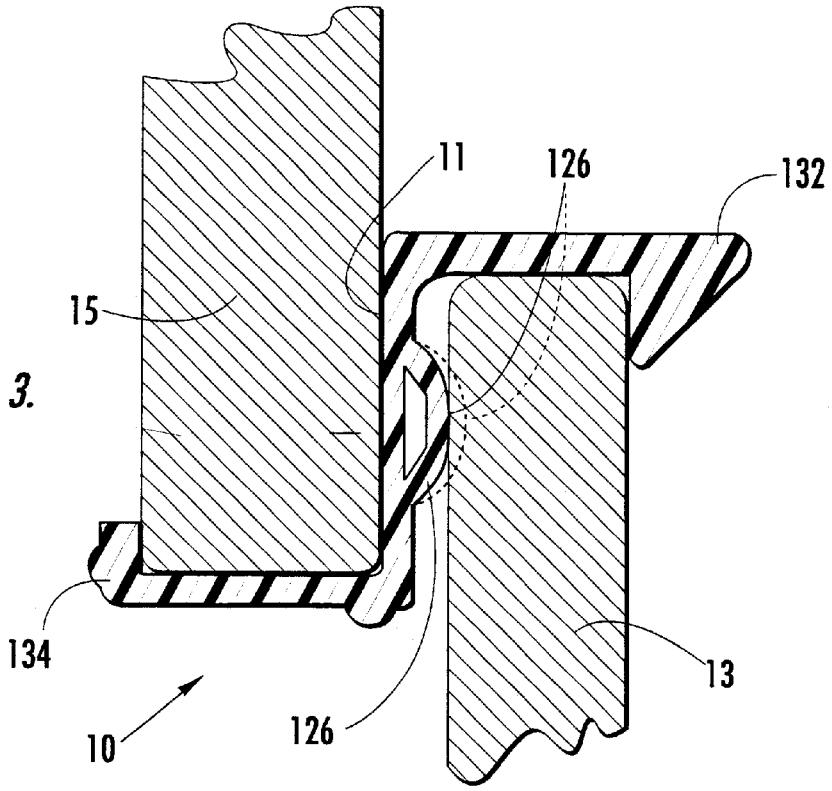
FIG. 3 illustrates the clip of FIG. 2 installed on a door and frame.

Referring to FIGS. 2 and 3, the clip 10 is configured to engage an edge portion of a door 13 and a frame member 15 and to restrain the door 13 from opening. The illustrated clip 10 includes a vertical segment 11, a portion 12 located at one end of the vertical segment 11 that is configured to engage a portion of the door 13, and a portion 14 located at the other end of the vertical segment 11 that is configured to engage a portion of the frame 15 when the door 13 is closed. The portion 14 includes a flange 134 for engaging the frame 15 and the portion 12 includes a wedge 132 for engaging the door 13. The door 13 contacts the cushion 126 and can be protected from damage thereby.

Figure 4:
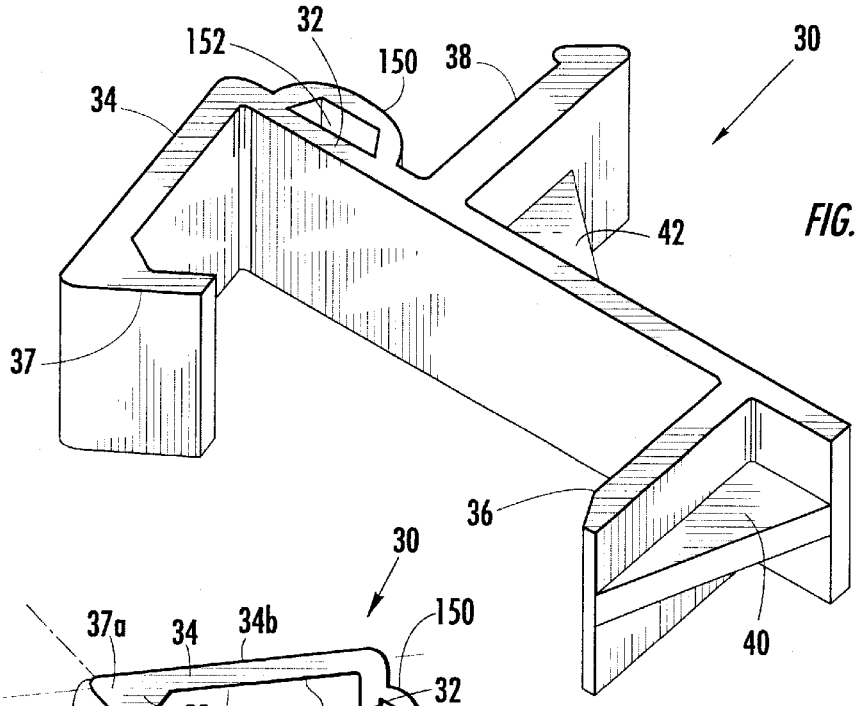
FIG. 4 is a perspective view of a cushioning restraining clip for restraining furniture doors during shipping and handling, according to embodiments of the present invention.
Figure 5:
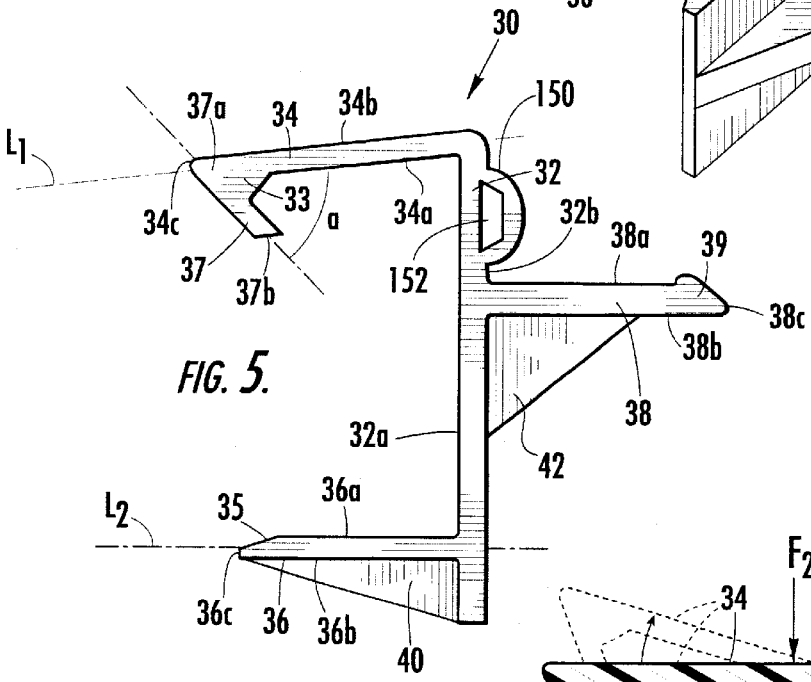
FIG. 5 is a side elevation view of the clip of FIG. 4 illustrating the clip in an uninstalled condition.

Referring now to FIGS. 4 and 5, a clip 30 for restraining furniture doors from both vertical and horizontal movement during shipping and handling according to embodiments of the present invention is illustrated. The clip 30 has a cushion 150 and a void 152. The clip 30 includes an elongated base member 32 having opposite sides 32*a*, 32*b*. A pair of elongated panels 34, 36 extend outwardly from the base member on side 32*a* in spaced-apart, opposing relationship, as illustrated. The panel 34 includes opposite sides 34*a*, 34*b*, and a free end 34*c*. The panel 36 includes opposite sides 36*a*, 36*b*, and a free end 36*c*. The panel free end 34*c* includes a hook 37 that is configured to removably secure the frame of an article of furniture (such as a cabinet or frame) against the base member on side 32*a*.

The illustrated hook 37 includes an end 37*a* that is secured to panel 34, and an opposite free end 37*b* that extends from the panel first side 34*a* in a direction toward the base member side 32*a*. A reinforcing fillet 33 is provided between the hook 37 and the first panel first side 34*a* to provide additional rigidity to the hook 37 and to help prevent the hook 37 from breaking off from the panel 34 when subjected to the loads experienced during the securing of a door. In the illustrated embodiment, the hook free end 37*b* extends from the panel side 34*a* at an angle a (FIG. 5) of between about 40 degrees and about 60 degrees.

Figure 6:
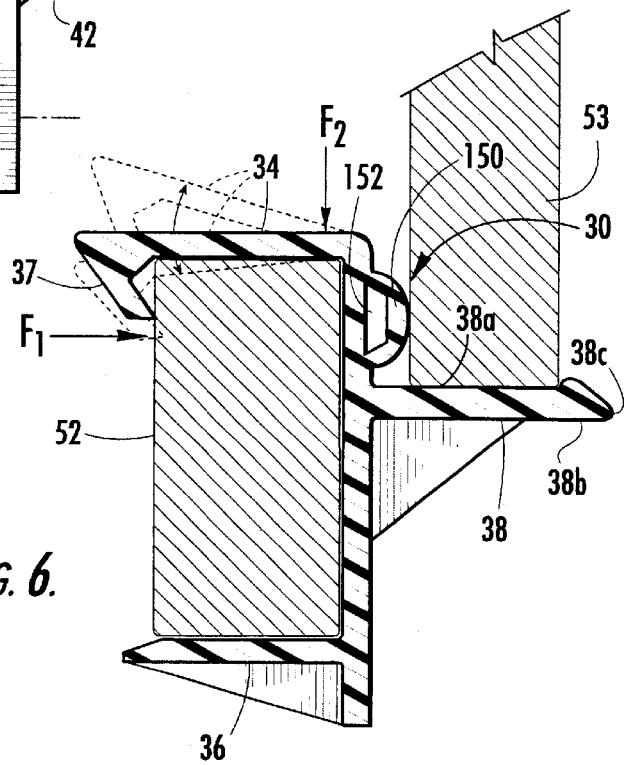
FIG. 6 illustrates the clip of FIG. 4 with a portion of a door frame removably secured between two panels.

As shown in FIG. 6, the panel 34 extends outwardly from the base panel side 32*a* in a direction $L_1$ that converges with the outwardly extending direction $L_2$ of the second panel 36 when in an uninstalled condition. When a portion of a frame 52 is inserted between the panels 34 and 36, the panel 34 bends away from the panel 36 to allow the frame 52 to be inserted between the panels 34 and 36. As illustrated in the phantom line in FIG. 6, the panel 34 tries to return to its uninstalled (i.e., relaxed) condition, thereby causing the hook 37 to impart biasing forces $F_1$ and $F_2$ against the frame 52, which push the frame 52 against the base member side 32*a* and panel 36.

The panel side 36*a* has a tapered portion 35 adjacent the panel free end 36*c*. The tapered portion 35 is designed to facilitate insertion of a frame between the panels 34 and 36. In the illustrated embodiment, a reinforcing member 40, in the form of a gusset, extends from the panel second side 36*b* to the base panel side 32*a*. The reinforcing member 40 is configured to provide additional strength and reduce deflection of the panel 36 caused by movement of a frame in a direction toward the panel 36. The reinforcing member 40 may have various configurations and shapes and is not limited to the illustrated embodiment.

An elongated panel 38 extends outwardly from the base member side 32*b*, as illustrated. The panel 38 includes opposite sides 38*a*, 38*b* and a free end 38*c*. The panel side 38*a* is configured to engage an end portion of door 53 (or the movable furniture component 53, such as a drawer) such that vertical movement of the door 53 relative to the frame is restrained. [[A]] The cushion 150 contacts the door 53 and protects the door 53 from the frame 52. In the illustrated embodiment, the panel side 38*a* includes a raised portion 39 adjacent the panel free end 38*c*. The raised portion 39 is configured to removably secure a door against the base member side 32*b*.

In the illustrated embodiment, a reinforcing member 42, in the form of a gusset, extends from the panel side 38*b* to the base panel side 32*b*. The reinforcing member 42 is configured to strengthen the panel 38 and reduce deflection of panel 38 caused by movement of the door 53 in a direction toward panel 38. The reinforcing member 42 may have various configurations and shapes and is not limited to the illustrated embodiment.

Figure 7:
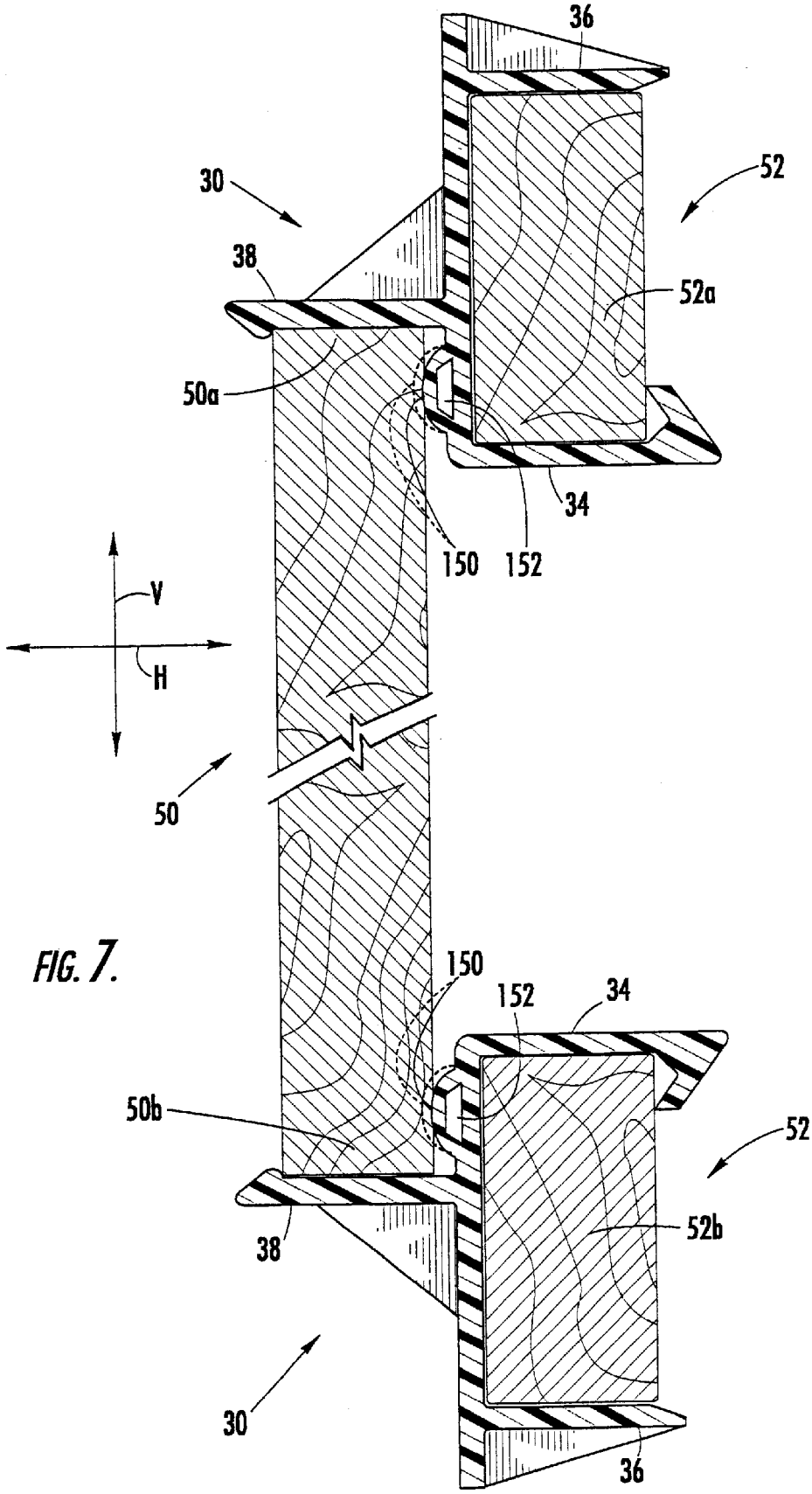
FIG. 7 illustrates a pair of clips according to the embodiment of FIG. 4 wherein one clip is secured to a top portion of a door and to an adjacent door frame portion, another clip is secured to a bottom portion of the door and to an adjacent door frame portion, and both clips restrain the door from both vertical and horizontal movement relative to the frame.

Referring now to FIG. 7, two clips 30 according to embodiments of the present invention are illustrated in an installed configuration on an article of furniture, such as a cabinet. One clip 30 is secured to an upper end portion 50*a* of a vertically hung furniture door 50 and to an adjacent upper frame portion 52*a* as illustrated. A second clip 30 is secured to a lower end portion 50*b* of the vertically hung furniture door 50 and to an adjacent lower frame portion 52*b* as illustrated. The respective clips 30 restrain the vertically hung door 50 in both vertical and horizontal directions indicated by arrows V and H. Cushions 150 and voids 152 contact the door 50 and may protect the door 50 and frame portions 52*a* and 52*b* from damage. Other types of opposing furniture components can be secured and protected by clips 30, including drawers and other components with one or more movable parts.

Figure 9:
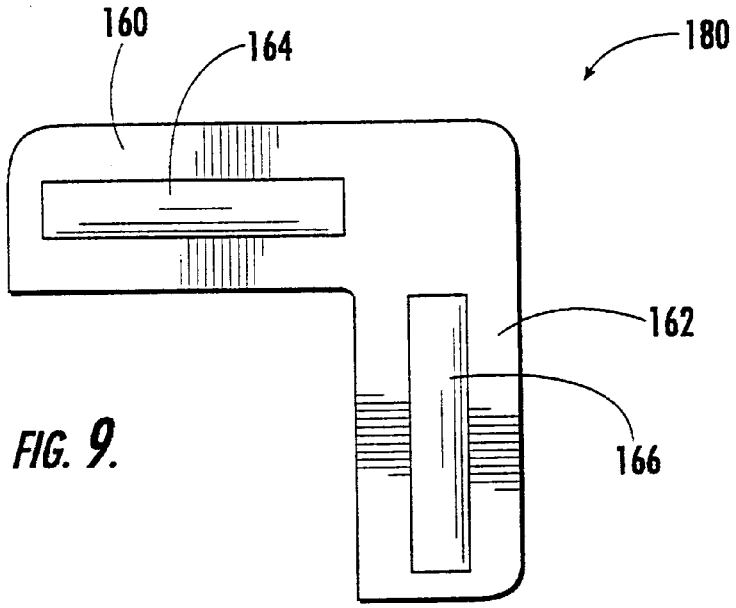
FIG. 9 is a front view of the cushioning device of FIG. 8.
Figure 10:
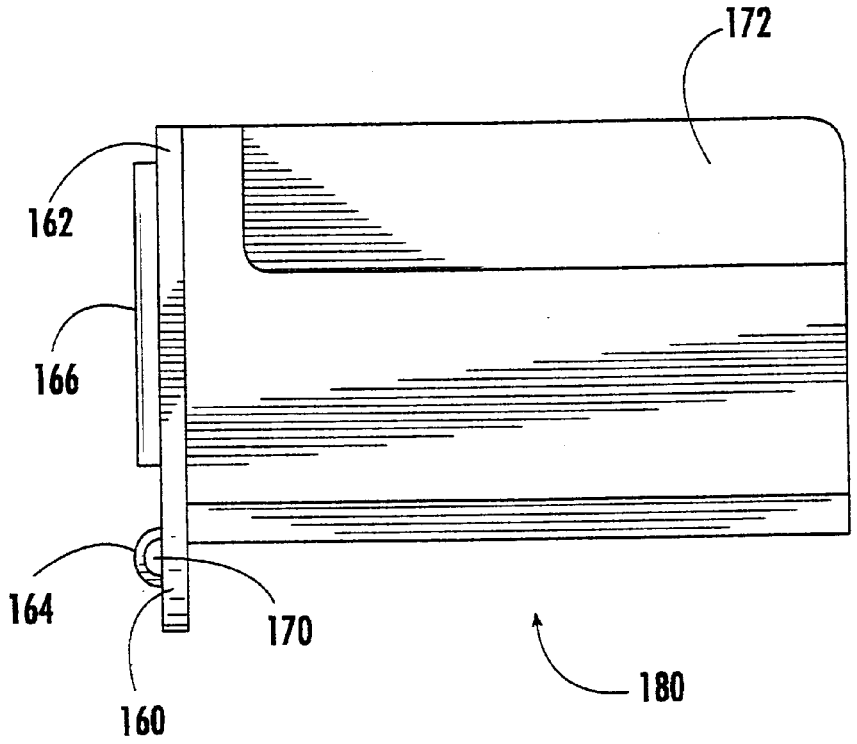
FIG. 10 is a side view of the cushioning device of FIG. 8.
Figure 11:
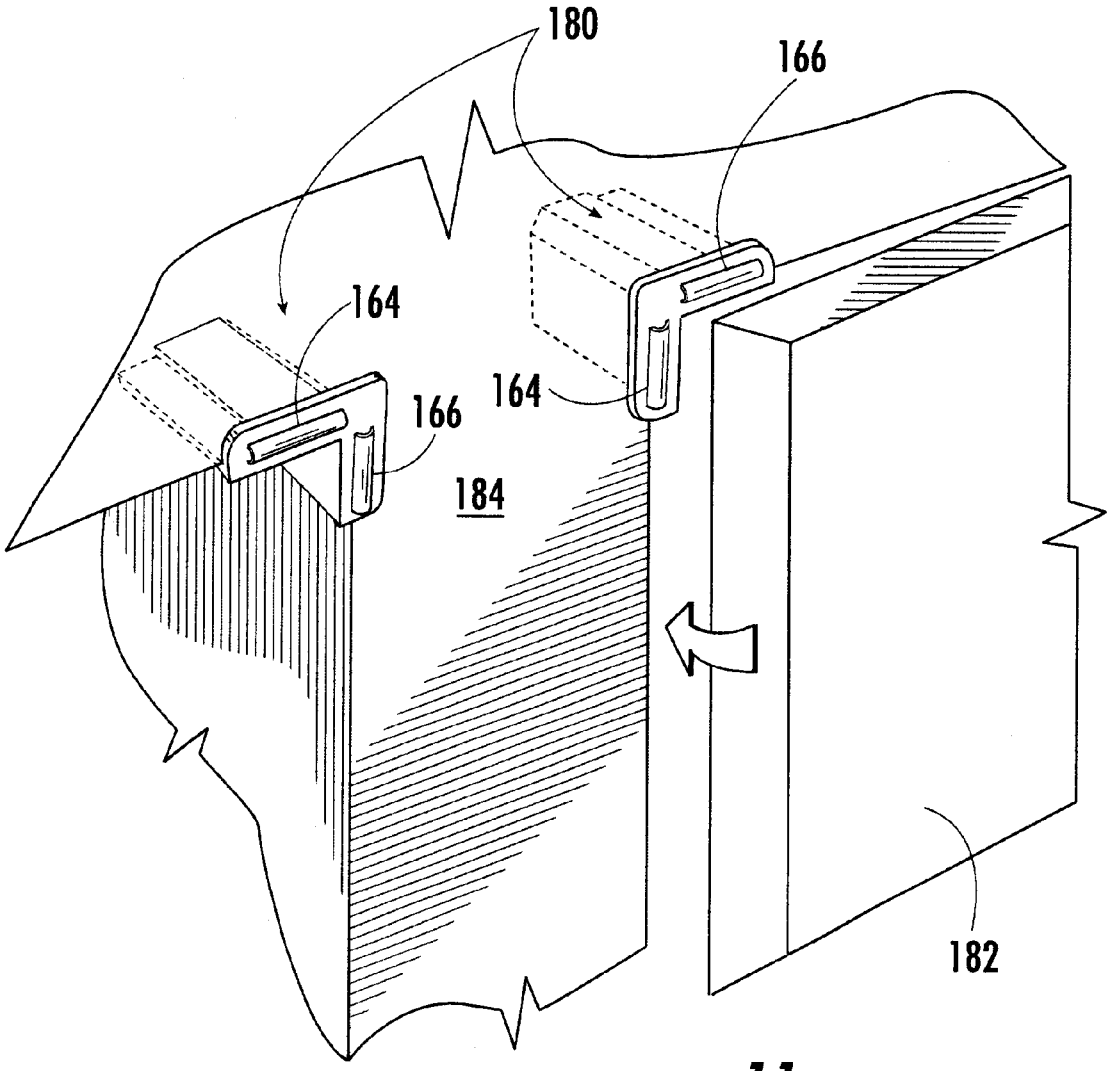
FIG. 11 illustrates a pair of cushioning devices according to the embodiments of FIG. 8 installed in the frame of a cabinet.

FIGS. 8–11 illustrate a protecting device 180 for protecting opposing furniture components (FIG. 11 illustrates the device 180 in an installed configuration on an article of furniture, such as a cabinet). In as much as the illustrated device 180 does not include a mechanism for restraining a door, for example, during shipping and handling, the device 180 may be suitable for protecting opposing furniture components during normal usage or other applications where the restraint of movable components is not necessary.

Figure 8:
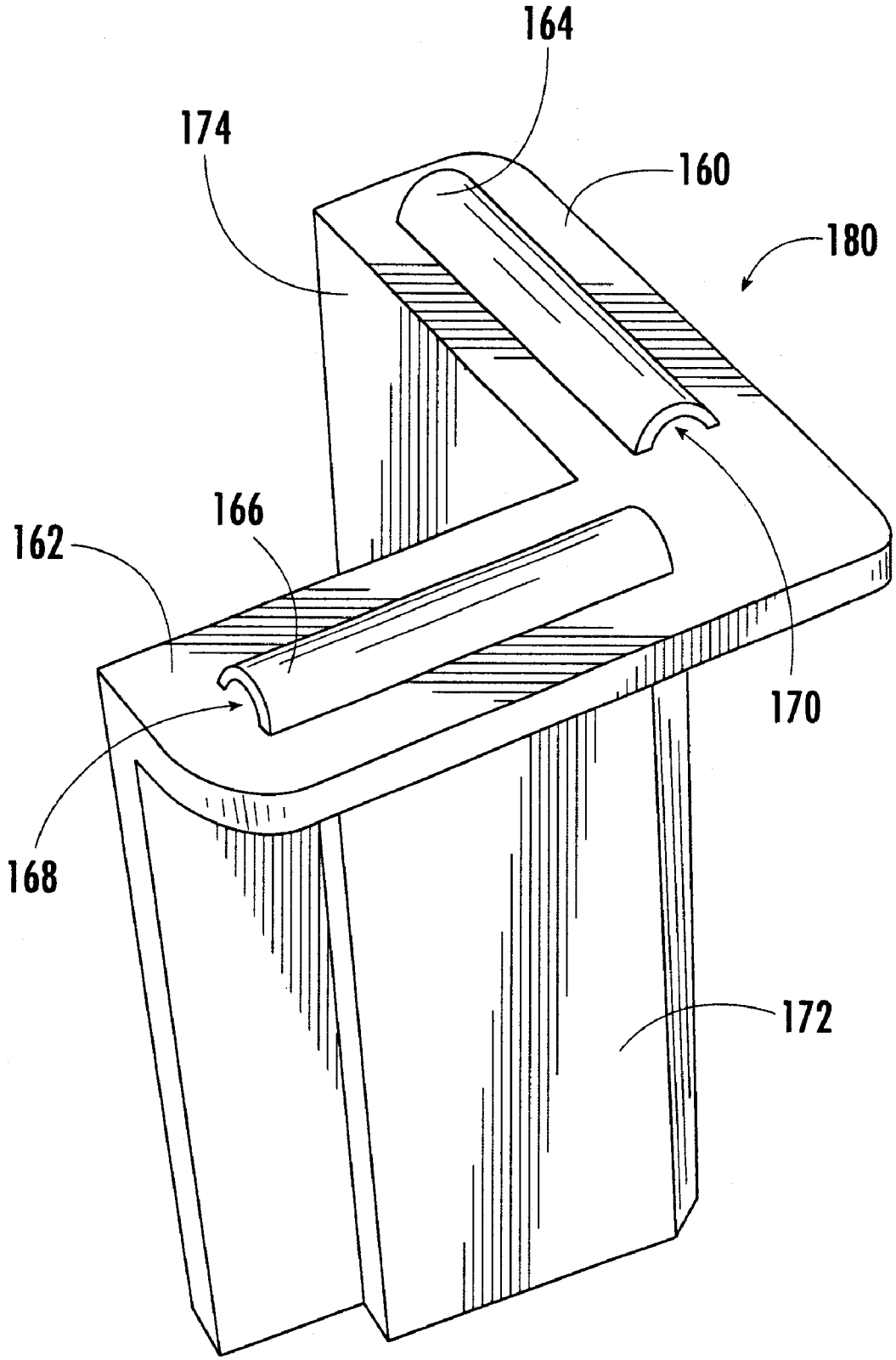
FIG. 8 is a perspective view of a cushioning device for protecting a frame from movement from a movable furniture component such as a drawer or door according to embodiments of the invention.

Referring to FIGS. 8–10, the device 180 includes two base members 160 and 162 that extend generally perpendicularly away from a common vertex. The device 180 includes [[a]] securing portions 172 and 174 for securing the device 180 to a furniture component such as a frame on a cabinet. The base members 160 and 162 have cushions 164 and 166 on a surface configured to contact a movable furniture component such as a drawer or door. Cushions 164 and 166 cover voids 168 and 170. Cushions 164 and 166 are elongated, and voids 168 and 170 extend lengthwise through cushions 164 and 166 to form an opening at either end of the cushions 164 and 166. Variously shaped cushions with closed or open ends may be used.

FIG. 11 illustrates the device 180 installed in the frame 184 of a door 182. A similar configuration may be used in a frame and drawer assembly or other furniture pieces having opposing components. The cushions 164 and 166 contact the door 182 when the door 182 is in the closed position and can protect the door 182 and/or the frame 184 from damage during use.

The device 180, cushions 100 (FIG. 1), and clips 30 (FIGS. 2–7) according to embodiments of the present invention can be manufactured from various materials using various processes understood by those of skill in the art. Exemplary materials include, but are not limited to, polymeric materials such as polyethylene and polypropylene, and exemplary manufacturing methods include, but are not limited to, injection molding, in particular gas assist molding (see U.S. Pat. Nos. 4,935,191 and 5,112,53, which are hereby incorporated herein by reference in their entireties, for a general description of gas assist molding).

In certain embodiments, the cushion can have a thickness between about 0.020 and 0.090 inches or preferably, between about 0.040 and about 0.070 inches. The base member can have a thickness between about 0.090 and 0.150 inches.

In gas assist molding, a mold including a pair of mating mold halves that form a cavity is provided. The cavity can be configured to form variously shaped devices according to embodiments of the invention. Molten polymeric material is injected into the cavity. A gas is injected into the cavity at a pressure sufficient to cause a void to form within the base member so that the cushioning projection covers the void. The polymeric material is cooled to a solid state such that it forms a cushioning device. Preferred gases for forming the void using a gas assist molding process include nitrogen. Preferred injection pressure for gasses forming the void are between about 400 psi and about 8,000 psi.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A device for securing and protecting confronting movable and frame members of a furniture piece, the device comprising:

a base member having opposite first and second faces, the first face adapted to contact the frame member, the base member having a cushioning projection extending outwardly from the second face of the base member and covering and defining a void within the base member, the projection adapted to contact the movable member as it confronts the frame member of the furniture piece; and a securing member extending outwardly from the base member second side configured to removably secure the movable member against the cushioning projection.

2. The device of claim 1, wherein the securing member has a hooked portion configured to secure the frame member against the base member first side.

3. The device of claim 1, further comprising a reinforcing member extending from the securing member to the second face of the base member.

4. The device of claim 1, further comprising an elongated member extending outwardly from the base member first face configured to removably secure a portion of the frame against the base member first face.

5. The device of claim 1, wherein the elongated member has a hooked portion configured to secure the frame member against the base member first side.

6. The device of claim 1, further comprising:

a pair of elongated first and second members extending outwardly from the base member first face in spaced-apart, opposing relationship and configured to removably secure a portion of the frame member against the base member first face.

7. The device of claim 6, wherein at least one of the pair of elongated first and second members has a hooked portion configured to secure the frame member against the base member first side.

8. The device of claim 1, wherein the device is formed as a unitary member.

9. The device of claim 1, wherein the device is formed of a polymeric material.

10. The device of claim 1, wherein the projection has a convex portion extending outwardly from the second face of the base member and a planar portion opposite the convex portion across the void.

11. The device of claim 10, wherein the planar portion of the projection has a thickness that is less than the thickness of the base member.

12. The device of claim 10, wherein the convex portion of the projection has a thickness that is less than the thickness of the base member.

13. The device of claim 1, wherein the cushioning projection is elongated in a direction generally perpendicular to the thickness of the base member.

14. The device of claim 1, wherein the cushioning projection is domed.

15. The device of claim 1, wherein the cushioning projection comprises an opening on at least one end.

16. The device of claim 1, wherein the cushioning projection is closed at both ends.

17. The device of claim 1, wherein the cushioning projection has a thickness of between about 0.020 and about 0.090 inches.

18. A device for protecting opposing furniture components, the device comprising:

first and second base members extending generally perpendicularly away from a common vertex, the first and second base members each having first and second opposing faces, the first face adapted to contact the first furniture component, the first and second base members each having a cushioning projection extending outwardly from the second faces of the base members and covering and defining a void within the base members, each projection adapted to contact the second furniture component as it confronts the first furniture component.

19. The device of claim 18, further comprising first and second securing members extending away from the first face of the base members and configured to secure the device in a corner of a furniture frame.

20. The device of claim 18, wherein the device is formed as a unitary member.

21. The device of claim 18, wherein the device is formed of a polymeric material.

22. The device of claim 18, wherein the projection has a convex portion extending outwardly from the second face of the base member and a planar portion opposite the convex portion across the void.

23. The device of claim 22, wherein the planar portion of the projection has a thickness that is less than the thickness of the base member.

24. The device of claim 22, wherein the convex portion of the projection has a thickness that is less than the thickness of the base member.

25. The device of claim 18, wherein the cushioning projection is elongated in a direction generally perpendicular to the thickness of the base member.

26. The device of claim 18, wherein the cushioning projection is domed.

27. The device of claim 18, wherein the cushioning projection comprises an opening on at least one end.

28. The device of claim 18, wherein the cushioning projection is closed at both ends.

29. The device of claim 18, wherein the cushioning projection has a thickness of between about 0.020 and about 0.090 inches.

30. An article of furniture, comprising:

a frame;

a movable member connected with the frame and movable from an open position to a closed position;

a device for protecting the movable member in a closed position relative to the frame, the device comprising:

a base member having opposite first and second faces, the first face adapted to contact the frame, the base member having a cushioning projection extending outwardly from the second face of the base member and covering and defining a void within the base member, the projection adapted to contact the movable member as it confronts the frame.

31. The article of furniture of claim 30, wherein the device has an elongated member configured to secure the first face to the frame.

32. The article of furniture of claim 30, wherein the device has a securing member extending outwardly from the base member second side configured to removably secure the movable member against the cushioning projection.

33. The article of furniture of claim 30, wherein the device is formed as a unitary member.

34. The article of furniture of claim 30, wherein the device is formed of a polymeric material.

35. The article of furniture of claim 30, wherein the projection has a convex portion and a planar portion.

36. The article of furniture of claim 35, wherein the planar portion of the projection has a thickness that is less than the thickness of the base member.

37. The article of furniture of claim 35, wherein the convex portion of the projection has a thickness that is less than the thickness of the base member.

38. The article of furniture of claim 30, wherein the cushioning projection is elongated in a direction generally perpendicular to the thickness of the base member.

39. The article of furniture of claim 30, wherein the cushioning projection is generally semi-circular.

40. The article of furniture of claim 30, wherein the cushioning projection comprises an opening on at least one end.

41. The article of furniture of claim 30, wherein the cushioning projection is closed at both ends.

42. The article of furniture of claim 30, wherein the cushioning projection has a thickness of between about 0.020 and about 0.090 inches.

* * * * *